US011639643B2

(12) United States Patent
Angstmann et al.

(10) Patent No.: US 11,639,643 B2
(45) Date of Patent: May 2, 2023

(54) KINETIC RAM HAVING PRESSURE RELIEF DEVICE

(71) Applicant: Kinetic Pressure Control Ltd., Houston, TX (US)

(72) Inventors: Steven Angstmann, Houston, TX (US); Bobby Gallagher, Houston, TX (US); Billy Gallagher, Houston, TX (US)

(73) Assignee: Kinetic Pressure Control Ltd., Houston, TX (US)

( * ) Notice: Subject to any disclaimer, the term of this patent is extended or adjusted under 35 U.S.C. 154(b) by 67 days.

(21) Appl. No.: 17/261,004

(22) PCT Filed: Jul. 30, 2019

(86) PCT No.: PCT/US2019/044084
§ 371 (c)(1),
(2) Date: Jan. 16, 2021

(87) PCT Pub. No.: WO2020/028330
PCT Pub. Date: Feb. 6, 2020

(65) Prior Publication Data

US 2021/0262311 A1 Aug. 26, 2021

Related U.S. Application Data

(60) Provisional application No. 62/712,744, filed on Jul. 31, 2018.

(51) Int. Cl.
*E21B 33/06* (2006.01)

(52) U.S. Cl.
CPC ..... *E21B 33/062* (2013.01)

(58) Field of Classification Search
CPC ..... E21B 33/021
USPC ..... 251/1.1, 1.2, 1.3; 137/70, 797
See application file for complete search history.

(56) References Cited

U.S. PATENT DOCUMENTS 2,149,641 A * 3/1939 Temple, Jr. ..... B21F 15/06 29/421.2
3,766,979 A 10/1973 Petrick
4,140,041 A * 2/1979 Frelau ..... F16K 13/06 137/68.13

(Continued)

OTHER PUBLICATIONS

Written Opinion of the International Search Authority, International Application No. PCT/US2019/044084, dated Nov. 18, 2019.

(Continued)

*Primary Examiner* — Daphne M Barry
(74) *Attorney, Agent, or Firm* — Victor H. Segura

(57) ABSTRACT

A kinetic ram for a blowout preventer includes a pressure chamber having a piston movably disposed therein. A gas generating charge disposed at one end of the pressure chamber. A ram is coupled to the piston on a side of the piston opposed to the gas generating charge. The ram is arranged to move across a through bore in a blowout preventer housing disposed at an opposed end of the pressure chamber. An initial volume in the pressure chamber between the one end and the piston is chosen to limit a maximum pressure caused by actuating the gas generating charge to a predetermined maximum pressure, and/or the pressure chamber comprises a pressure relief device arranged to vent pressure in the pressure chamber above the maximum pressure.

23 Claims, 10 Drawing Sheets

(56) References Cited

U.S. PATENT DOCUMENTS

| | | | | |
|---|---|---|---|---|
| 5,217,073 | A | 6/1993 | Bruns | |
| 8,567,427 | B1 * | 10/2013 | Milanovich | E21B 43/116 251/282 |
| 8,794,308 | B1 | 8/2014 | Milanovich | |
| 9,488,024 | B2 * | 11/2016 | Hoffman | E21B 33/035 |
| 11,028,664 | B2 * | 6/2021 | Gallagher | E21B 33/063 |
| 2017/0218717 | A1 * | 8/2017 | Brinsden | E21B 33/063 |
| 2018/0080300 | A1 * | 3/2018 | Angstmann | E21B 33/063 |
| 2018/0238132 | A1 | 8/2018 | Oag | |
| 2019/0203555 | A1 * | 7/2019 | Gallagher | E21B 33/063 |
| 2021/0032951 | A1 * | 2/2021 | Angstmann | E21B 33/064 |

OTHER PUBLICATIONS

International Search Report, International Application No. PCT/US2019/044084, dated Nov. 18, 2019.

* cited by examiner

KINETIC RAM HAVING PRESSURE RELIEF DEVICE

Continuation of International Application No. PCT/US2019/044084 filed on Jul. 30, 2019. Priority is claimed from U.S. Provisional Application No. 62/712,774 filed on Jul. 31, 2018.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of well pressure control apparatus such as blowout preventers ("BOPs"). More particularly the disclosure relates to pyrotechnically generated, gas pressure operated valves ("rams") used in BOPs. BOPs for oil and gas wells are used, among certain reasons, to prevent potentially catastrophic events known as blowouts, where high well fluid pressures and uncontrolled fluid flow from a subsurface formation into the well can expel tubing (e.g., drill pipe and well casing), tools and drilling fluid out of a well. Blowouts present a serious safety hazard to drilling crew, the drilling rig and the environment and can be extremely costly. Typically BOPs have "rams" that are opened and closed by actuators. The most common type of actuator is operated hydraulically to push closure elements into or across a through bore in a BOP housing (itself sealingly coupled to the well) to close the well. In some cases, the rams have hardened steel shears to cut through a drill string or other tools or devices which may be in the well and thus in the through bore at the time it is necessary to close the BOP.

A limitation of hydraulically actuated rams is that they require a large amount of hydraulic force to move the rams against the pressure inside the wellbore (and thus in the through bore) and in the case of shear rams subsequently to cut through objects in the through bore.

An additional limitation of hydraulically actuated rams is that the hydraulic force is typically generated at a location away from the BOP (necessitating a hydraulic line from the pressure source to the rams), making the BOP susceptible to failure to close if the hydraulic line conveying the hydraulic force is damaged. Other problems associated with hydraulically actuated rams may include erosion of cutting and sealing surfaces on the rams due to the relatively slow closing of the rams in a flowing wellbore. Cutting through tool joints, drill collars, large diameter tubulars and off-center pipe strings under heavy compression may also present problems for hydraulically actuated rams.

Pyrotechnic gas pressure operated BOP rams have been proposed which address some of the limitations of hydraulically actuated BOPs. An example of such a pyrotechnic gas pressure operated BOP is described in International Application Publication No. WO 2016/176725 filed by Kinetic Pressure Control Limited. A limitation of pyrotechnic based BOPs such as disclosed in the foregoing publication is that in the event the ram becomes stuck in its passageway, pressure in the pyrotechnic firing chamber can build to a point where the pressure vessel would fail. Such failure risk is based on the fact that such BOP rams rely on the progression of a piston used to move the ram to increase the volume in the firing chamber as the pyrotechnic charge generates gas.

SUMMARY

A kinetic ram for a blowout preventer according to one aspect of the disclosure includes a pressure chamber having a piston movably disposed therein. A gas generating charge disposed at one end of the pressure chamber. A ram is coupled to the piston on a side of the piston opposed to the gas generating charge. The ram is arranged to move across a through bore in a blowout preventer housing disposed at an opposed end of the pressure chamber. An initial volume in the pressure chamber between the one end and the piston is chosen to limit a maximum pressure caused by actuating the gas generating charge to a predetermined maximum pressure, and/or the pressure chamber comprises a pressure relief device arranged to vent pressure in the pressure chamber above the maximum pressure.

In some embodiments, the maximum pressure is at most three times an operating pressure to accelerate the piston to a selected velocity.

In some embodiments, the maximum pressure is at most one- and one-half times an operating pressure to accelerate the piston to a selected velocity.

In some embodiments, the maximum pressure is at most five times an operating pressure to accelerate the piston to a selected velocity.

In some embodiments the initial volume is chosen by providing a selected initial distance between the gas generating charge and the piston.

In some embodiments, the initial volume is chosen by providing at least one pressure relief hole in at least one of the pistons and an interior wall of the pressure chamber.

In some embodiments, the at least one pressure relief hole is covered by a burst disk.

Some embodiments further comprise a restraint coupled to the piston and arranged to hold the piston against pressure in the pressure chamber until the pressure in the pressure chamber exceeds a selected amount.

In some embodiments, the restraint comprises at least one shear pin.

In some embodiments, the restraint comprises an integral attachment forming part of the gas generating charge.

Some embodiments comprise a second pressure chamber having a second piston movably disposed therein, a second gas generating charge disposed at one end of the second pressure chamber, a second ram coupled to the second piston on a side of the second piston opposed to the second gas generating charge, the second ram arranged to move across the through bore or a through bore in a second blowout preventer housing disposed at an opposed end of the second pressure chamber and wherein at least one of, an initial volume in the second pressure chamber between the one end and the second piston is chosen to limit a maximum pressure caused by actuating the second gas generating charge to a predetermined maximum pressure, and the second pressure chamber comprises a pressure relief device arranged to vent pressure in the pressure chamber above the maximum pressure. Such embodiments may have the ram and the second ram moving in opposed directions with reference to the first through bore.

DETAILED DESCRIPTION

Figure 1:
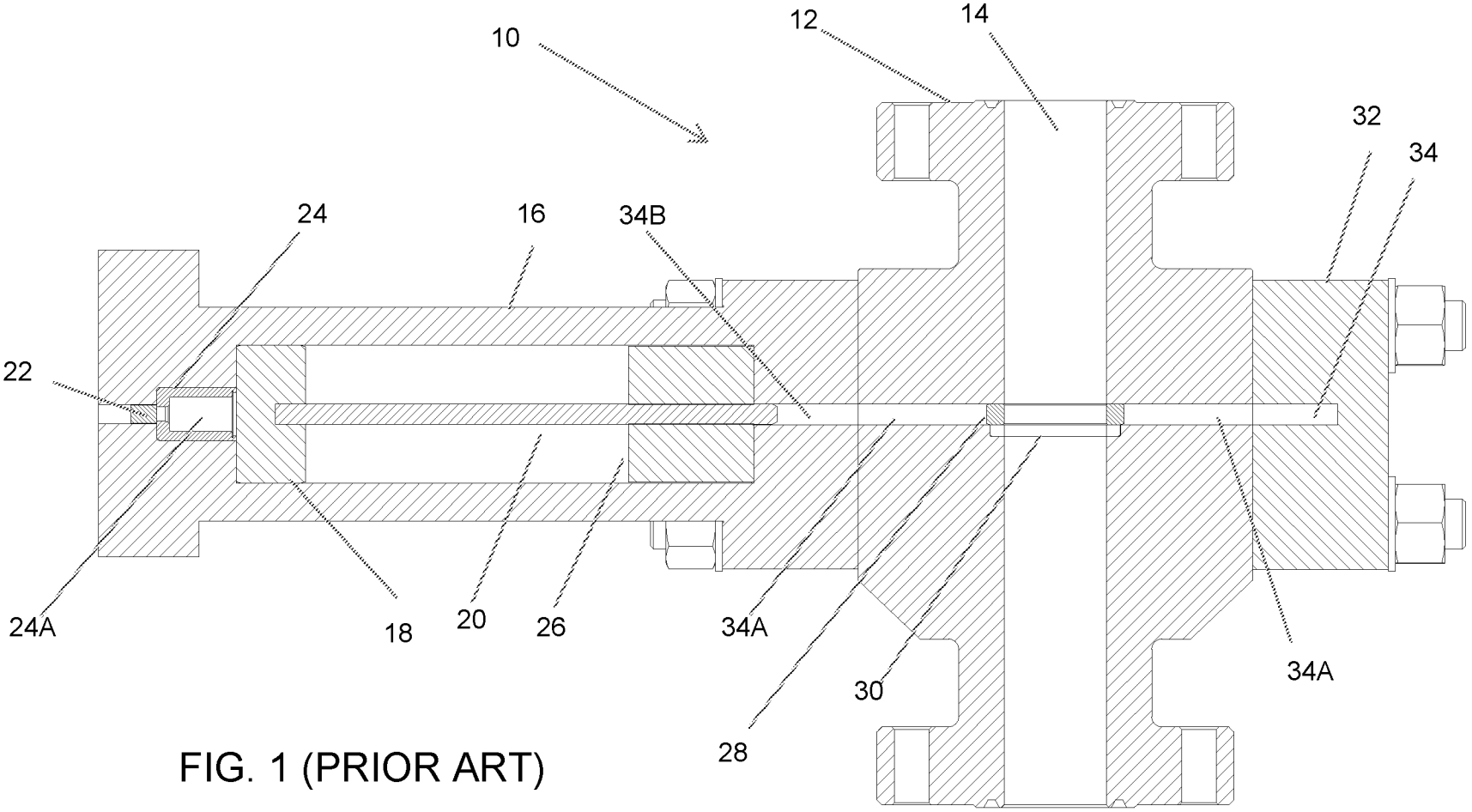
FIG. 1 (PRIOR ART)
FIG. 1 shows a side view of a pyrotechnic gas operated BOP known in the art prior to the present disclosure.
Figure 2:
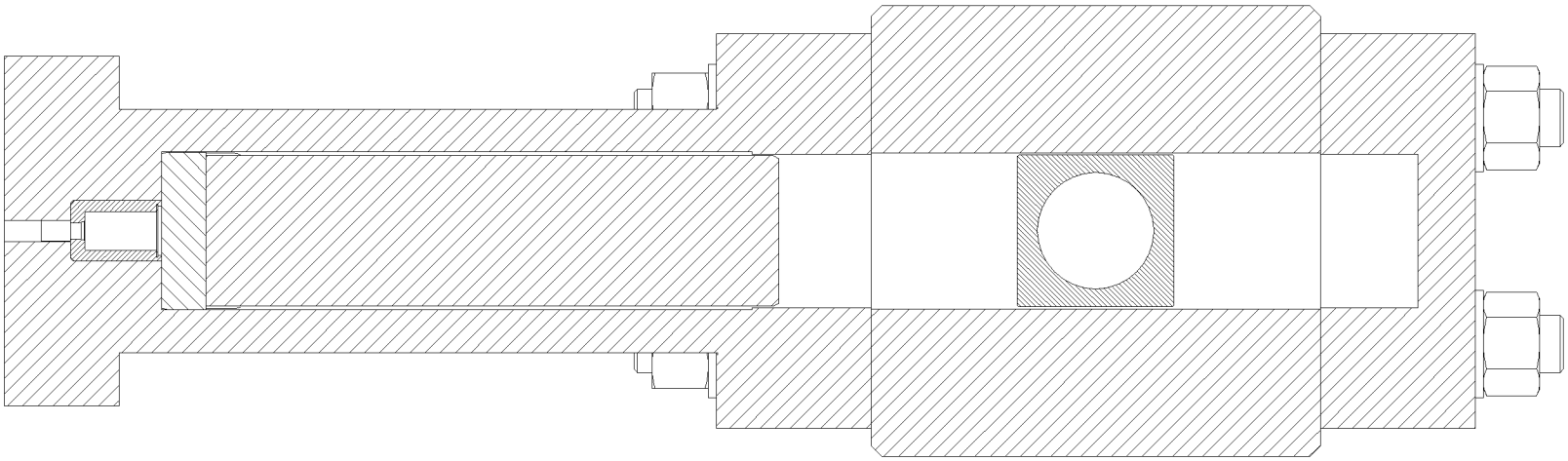
FIG. 2 (PRIOR ART)
FIG. 2 shows a plan view of the BOP shown in FIG. 1.

In the following detailed description, like components common the several drawings are identified with like reference numerals. FIG. 1 and FIG. 2 show, respectively, a side view and a plan view of a pyrotechnic gas operated BOP known in the art prior to the present disclosure. A non-limiting example of such a BOP is described in International Application Publication No. WO 2016/176725 filed by Kinetic Pressure Control Limited.

A pyrotechnic gas pressure operated BOP 10, which may also be referred to as a "kinetic BOP" comprises a housing 12 having a through bore 14. The housing 12 may be coupled to a wellhead, another BOP or a similar structure so that such similar structure may be closed to flow by operating the kinetic BOP 10. A passageway 34 may be formed in a receiving cover 32 coupled to one side of the housing 12. The housing 12 may comprise a part 34A of the passageway adjacent to the passageway 34 in the receiving cover 32. A further part 34B of the passageway may be formed in a pressure chamber 16 coupled to an opposed side of the housing 12. The passageway 34 and its parts 34A, 34B provide a travel path for a ram 20. The travel path enables the ram 20 to attain sufficient velocity resulting from actuation of a pyrotechnic charge 24 and subsequent gas expansion against a piston 18 such that kinetic energy in the ram 20 may be sufficient to sever any device disposed in the through bore 14 and to enable the ram 20 to extend into the passageway 34 across the through bore 14. A ring cutter 28 is disposed in the passageway coincident with the through bore 14. A seal 30 may provide effective flow closure between the through bore 14 and the ram 20 when the ram 20 is moved into the through bore 14 such that fluid pressure in the through bore 14 is excluded from the passageway 34 and parts 34A, 34B thereof. When the ram 20 is disposed across the through bore 14 after actuation of the pyrotechnic charge 24, the through bore 14 is thereby effectively closed to flow across the ram 20. The piston 18 may be decelerated by a brake 26 such as a crush sleeve or similar device such that the piston 18 does not strike the housing 12 so as to damage the housing 12. The pyrotechnic charge 24 may be actuated by an initiator 22 of types well known in the art.

As may be determined with reference to the '725 publication cited above, upon initial actuation of the pyrotechnic charge 24, there is a relatively small volume between the charge and the piston 18 before the piston 18 has begun to move. Such volume may be referred to as the "initial volume." There is also typically an amount of free volume inside the charge 24 itself because the propellant in the charge 24 is typically supplied as a granular substance.

The relatively small initial volume is needed for proper function of the BOP 10 as such initial volume enables a high gas pressure to be generated rapidly on actuation of the charge 24, which provides a motive force to accelerate the piston 18 and consequently the ram 20. In addition, propellants used in such BOPs, such as a nitrocellulose- and/or nitroglycerin-based propellants, the rate of combustion of the propellant is related to the maximum gas pressure induced within a gas chamber 24A disposed between the charge 24 and the piston 18. Without the high pressure being generated, the piston 18 would not be accelerated to its required velocity. For purposes of defining the scope of the present disclosure it should be understood that a separate ram and piston are equivalent structures to an integral piston and ram, wherein such structures are functionally similar.

A drawback of having a small initial volume occurs in a "jamming event." If the piston 18 and/or the ram 20 becomes jammed during actuation, and the initial volume does not increase as a result of piston 18 movement, the pressure developed within the pressure chamber 16 behind the piston 18 could be substantially greater than the normal or desired BOP actuating pressure. Depending on where in the passage the piston 18 and/or the ram 20 becomes jammed, the pressure in the pressure chamber 16 may become many times the normal or desired actuating pressure. Such elevated pressure may result in failure of the pressure chamber 16. It would be possible to design a pressure chamber capable of withstanding pressure that is multiples of the desired BOP actuating pressure, but it may be reasonably expected that such a pressure chamber would be bulky, expensive, and therefore impractical.

Figure 3:
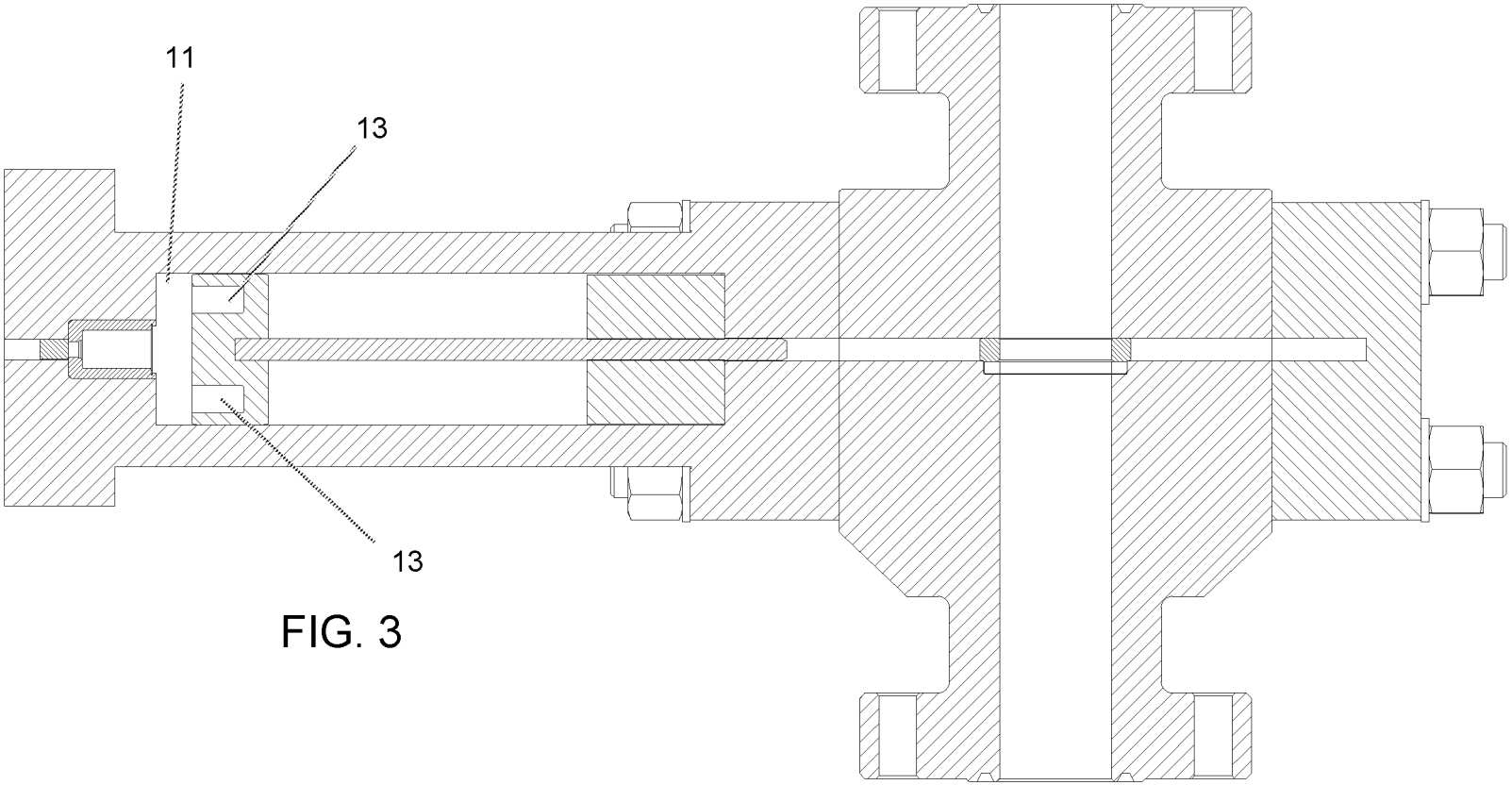
FIGS. 3, 4 and 5 show, respectively a side view and plan views of an example embodiment of a BOP according to the present disclosure.

According to the present disclosure, the initial volume may be chosen and/or actuatable features may be provided so that the minimum chamber volume is at least an amount chosen to limit the maximum pressure in the pressure chamber 16 in a jamming event to a predetermined limit pressure. In some embodiments, and referring to FIG. 3, the initial volume may be chosen using one or more various structures including, for example, increasing an initial distance 11 between the charge 24 and the piston 18, milling relief holes 13 into the piston 18, and/or milling relief holes (not shown) into the interior wall of the chamber 16.

In some embodiments, the initial distance 11 and/or volume of relief holes 13 may be chosen such that the total volume limits gas pressure in the pressure chamber 16 in the event of piston or ram jamming to at most 1.5 times the desired actuating pressure.

In some embodiments, the initial distance 11 and/or volume of relief holes 13 may be chosen such that the total volume limits gas pressure in the pressure chamber 16 in the event of piston or ram jamming to at most 3 times the desired actuating pressure.

In some embodiments, the initial distance 11 and/or volume of relief holes 13 may be chosen such that the total volume limits gas pressure in the pressure chamber 16 in the event of piston or ram jamming to at most 5 times the desired actuating pressure.

Figure 4:
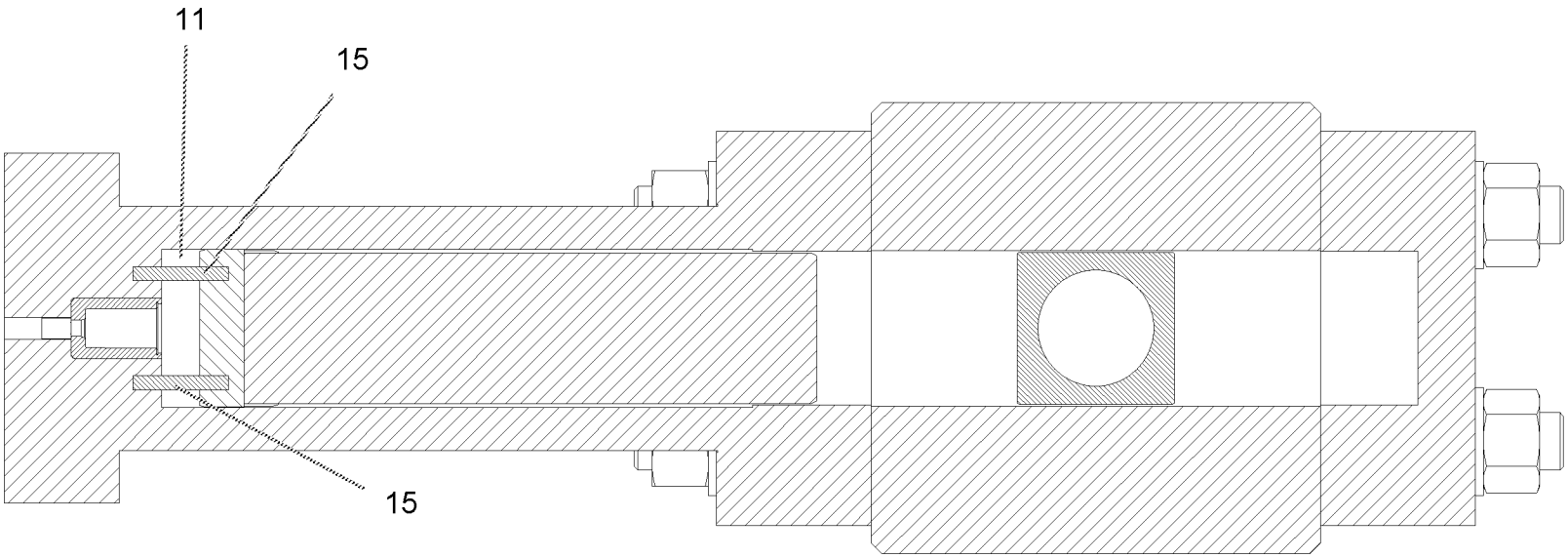
Figure 5:
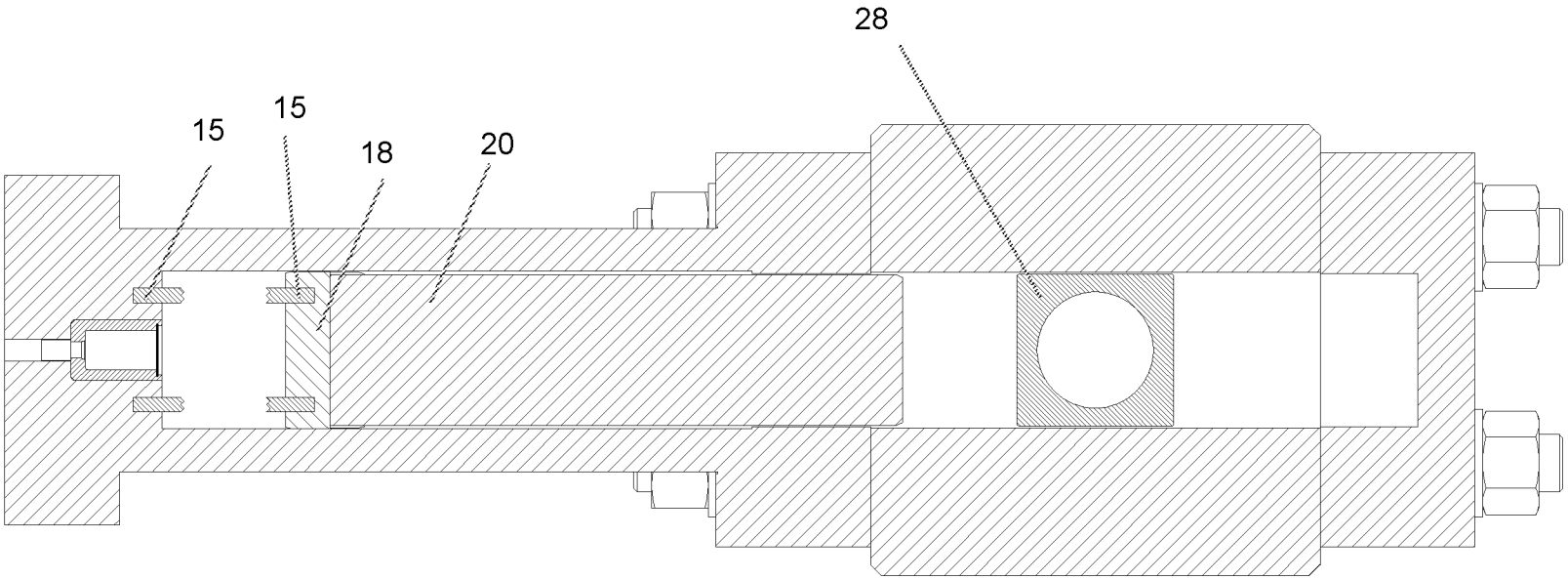

In order to maintain the performance of the BOP and to successfully accelerate the piston 18 at the desired rate, and referring to FIG. 4, in some embodiments, hold back shear pins 15 may be used to hold the piston 18 initially at a selected initial distance 11. The initial distance 11 in some embodiments may be chosen such that the initial volume limits the maximum pressure in the pressure chamber 16 as explained above. The shear pins 15 have a chosen breaking strength to hold the piston 18 in place until the desired pressure (which maximum pressure may be limited as explained above) is reached, thus allowing the piston 18 to accelerate to a higher velocity over a shorter distance. In addition, by allowing pressure to build in the pressure chamber 16, a faster combustion of the charge 24 may take place. FIG. 5 shows the shear pins 15 having been ruptured when the pressure in the chamber 16 causes force on the piston 18 to exceed the breaking strength of the shear pins 15, thus accelerating the piston 18 and the ram 20.

Figure 6:
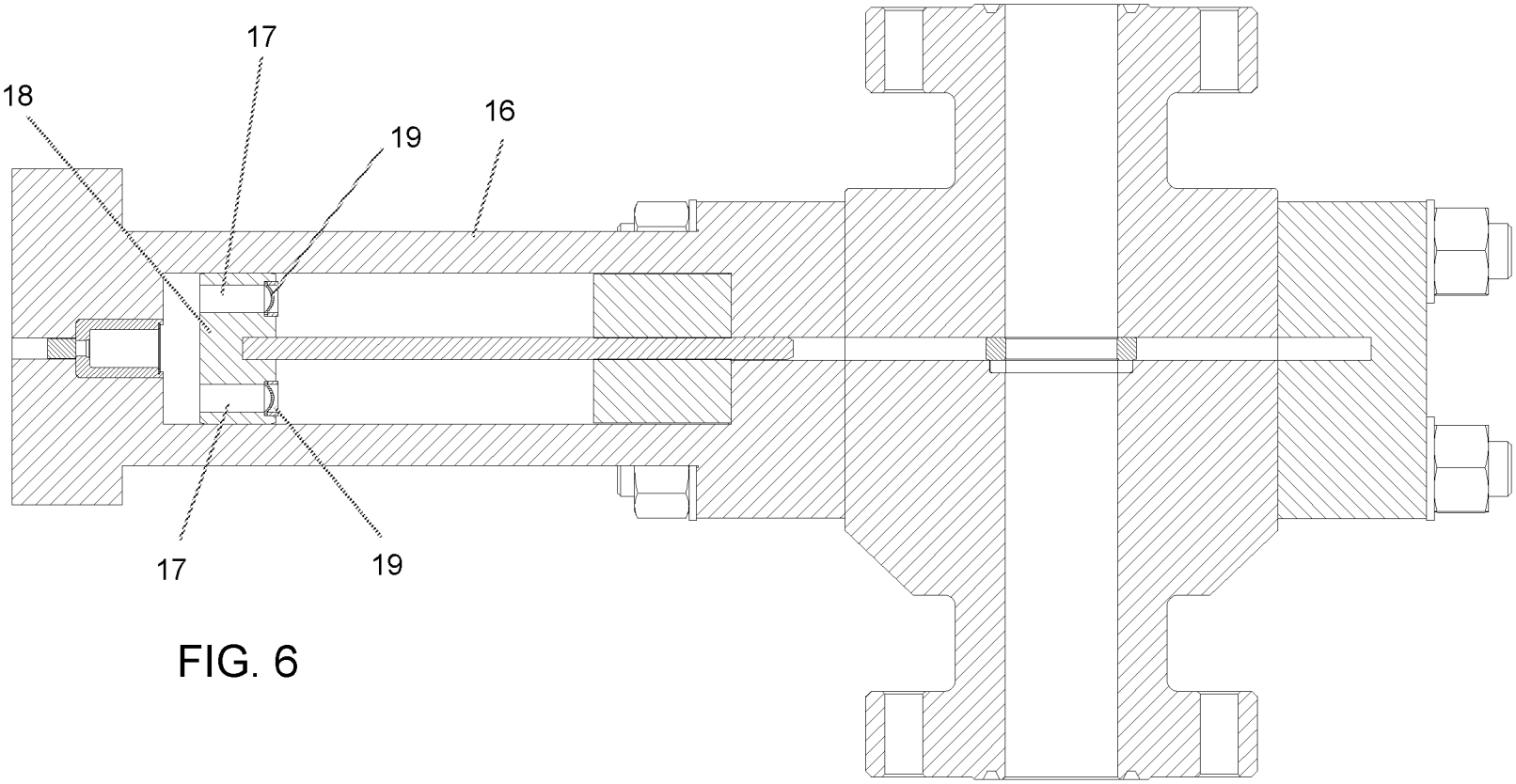
FIGS. 6 and 7 show another example embodiment of a BOP according to the present disclosure.

FIG. 6 shows another embodiment comprising relief holes 17 in the piston each terminated by a burst disk 19. In order to minimize the amount of initial free volume but still maintain a safe device where the pressure chamber 16 will not fail in a jamming event a burst disk 19 or similar pressure relief valve may in installed in a corresponding hole 17 the piston 18. In the event the pressure in the chamber 16 rises to a predetermined level above the desired actuating pressure the burst disk(s) 19 will fail, whereby pressure is relieved to the opposite side of the piston 18. This relief of pressure may prevent the failure of the chamber 16.

Figure 7:
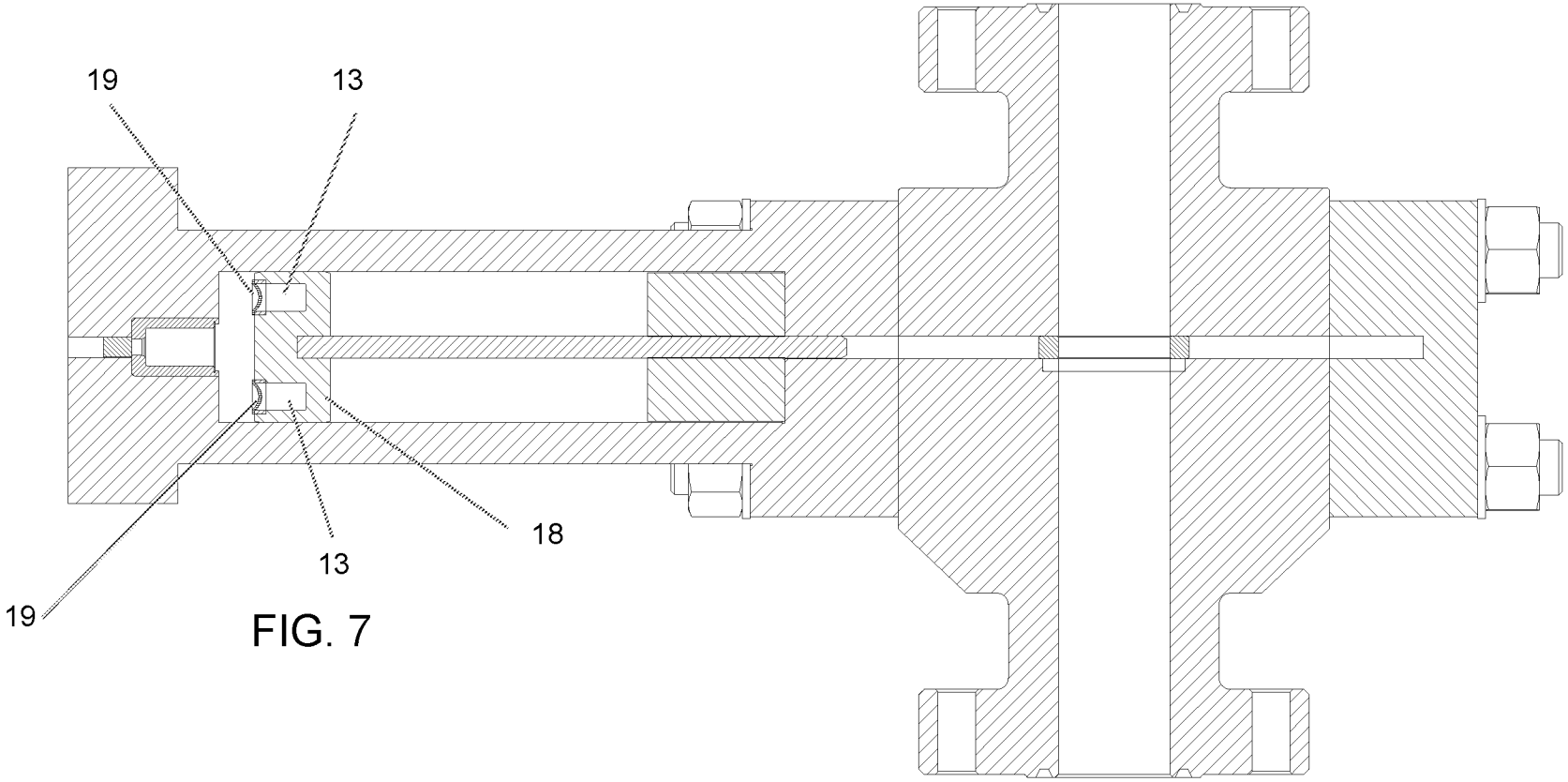

FIG. 7 shows another embodiment corresponding to the example embodiment shown in FIG. 6, wherein relief holes 13 in the piston 18 do not extend all the way through the face of the piston 18. Such relief holes 13 may be similar to those explained with reference to FIG. 3. In the present embodiment, the relief hole(s) 13 may be closed by a respective burst disk 19. In the event the pressure chamber 16 pressure rises to a predetermined level above the desired actuating pressure, the burst disk(s) 19 will fail, and the volume in the pressure chamber 16 is then increased by the volume of the relief hole(s) 13.

In some embodiments, the additional volume introduced by failure of the burst disk(s) 19 is enough to limit pressure rise in a jamming event to no more than 3 times the desired firing pressure. In some embodiments, the additional volume introduced by failure of the burst disk(s) 19 is enough to limit pressure rise in a jamming event to no more than 5 times the desired firing pressure.

In some embodiments, the additional volume introduced by failure of the burst disk(s) 19 is enough to limit pressure rise in a jamming event to no more than 1.5 times the desired firing pressure.

Figure 8:
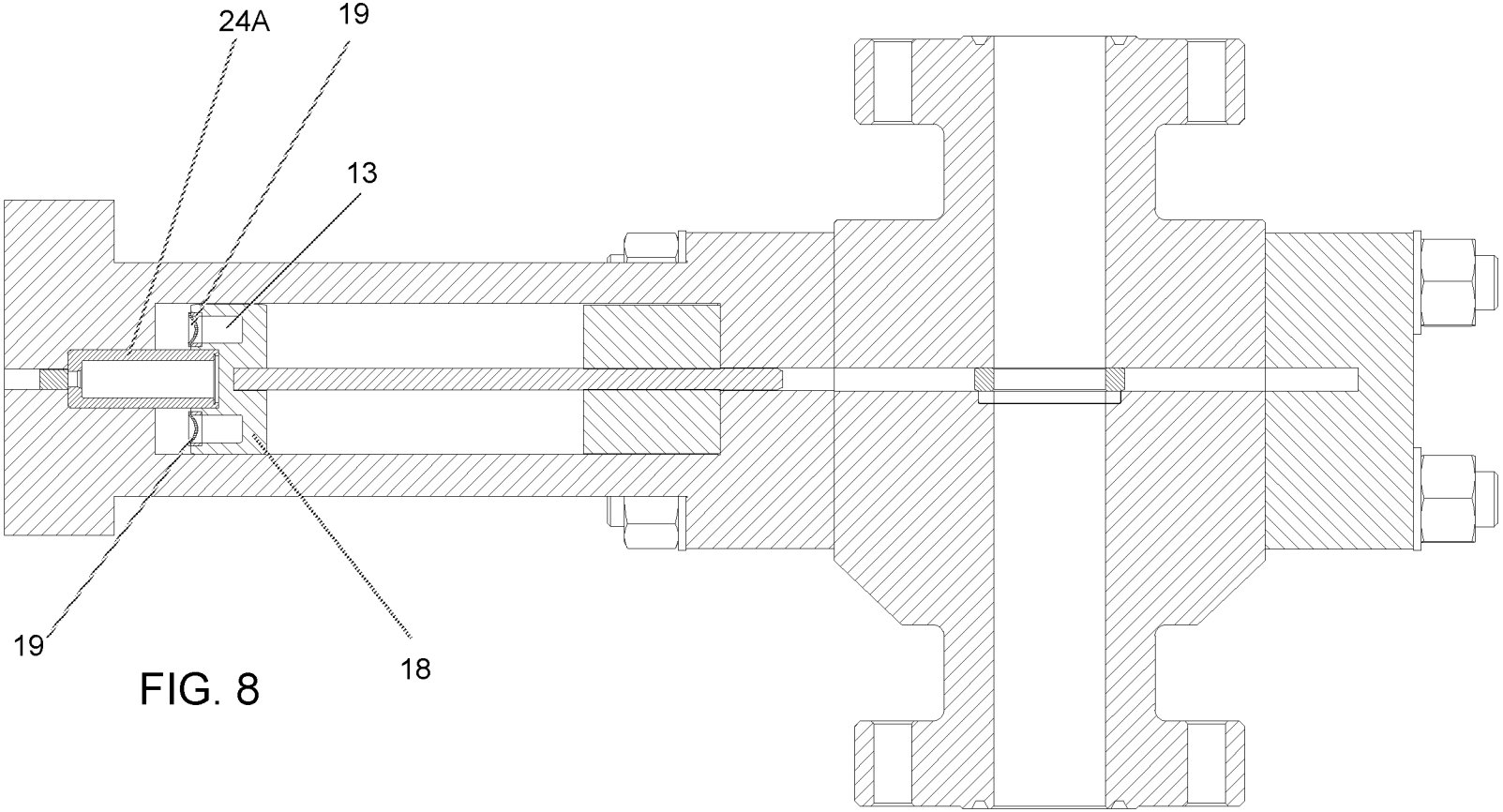
FIGS. 8 and 9 show another example embodiment of a BOP according to the present disclosure.
Figure 9:
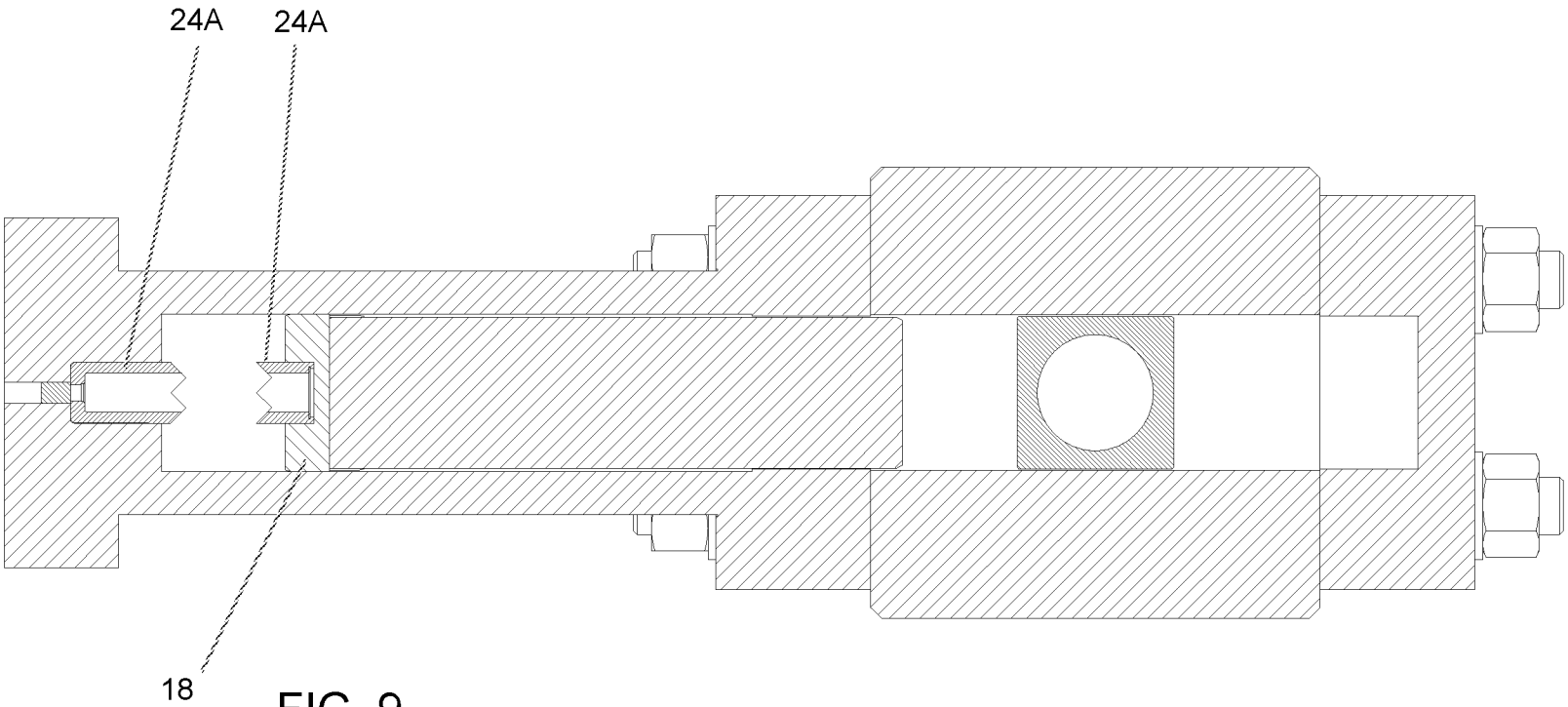
Figure 10:
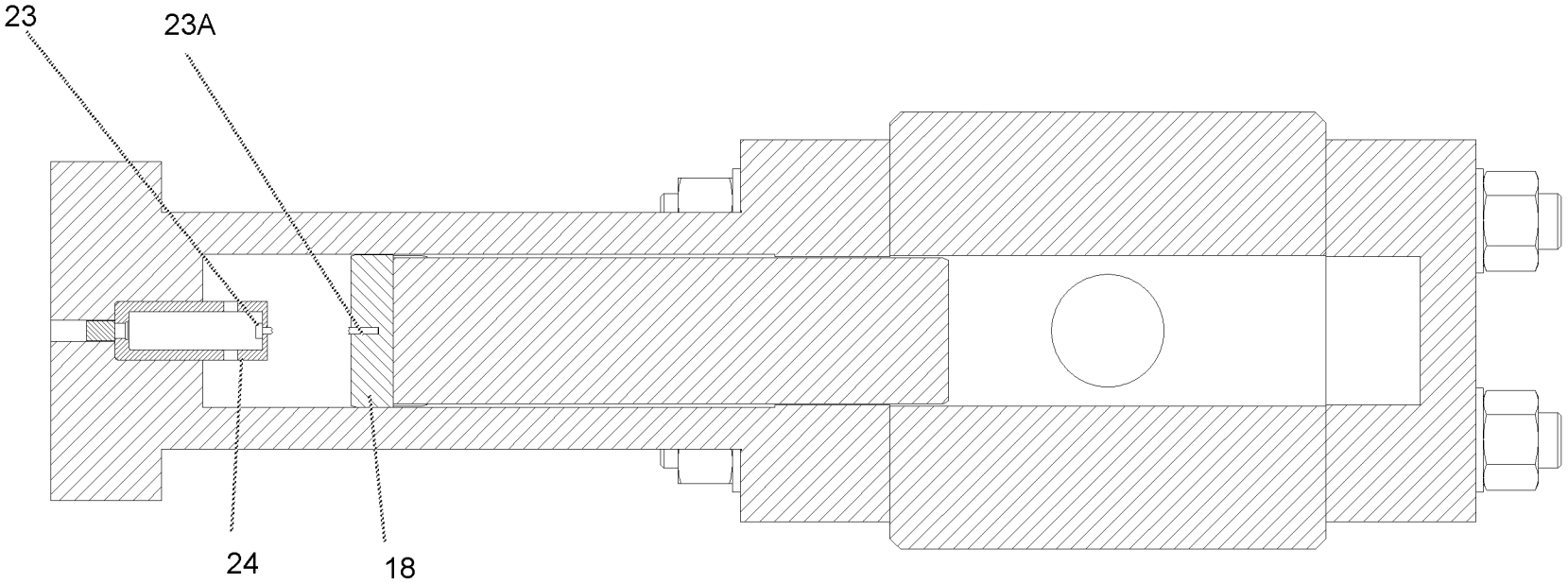
FIG. 10 shows another example embodiment similar in principle to the embodiment shown in FIGS. 8 and 9.

In some instances, shear pins such as may be used in the example embodiments explained with reference to FIGS. 4 and 5 may be undesirable because they can provide significant and uneven stress increases on the pressure chamber 16. It is therefore more desirable to centrally locate a restraint or "hold back" device similar in function to shear pins, but this is difficult to obtain in practice because the charge 24 is located so as to be in the way. In some embodiments, the charge 24 itself or its housing can also act as a hold back device. In such embodiments, the charge 24 may comprise integral attachments 24A to couple the charge 24 to the piston 18. The charge 24 itself can now also perform the same function as the shear pins (15 in FIG. 4) by restraining the piston 18 until a desired chamber pressure is reached. Such restraint enables the piston 18 to accelerate to a higher velocity over a shorter distance. In addition, by allowing pressure to build in the pressure chamber 16 a faster combustion of the charge 24 may be obtained. The embodiment shown in FIG. 8 may comprise relief holes 13 in the piston 18 as explained with reference to FIG. 7 and may further comprise burst disks to close such relief holes 13 also as explained with reference to FIG. 7. FIG. 9 shows the embodiment of FIG. 8 after initiation of the charge 24 and subsequent rupture of the integral attachments 24A. FIG. 9 shows the piston 18 without relief holes 13 and burst disks 15 as in FIG. 8 only to illustrate that such embodiment is possible. Another example embodiment which may use a similar principle to the embodiment shown in FIGS. 8 and 9 is shown in FIG. 10, in which the charge 24 may be coupled to the piston 18 using a shear bolt 23 or similar attachment that is designed to fail at a selected force, e.g., tension, above a predetermined threshold. In FIG. 10 the shear bolt 23 has been ruptured after initiation of the charge 24 and development of the requisite gas pressure.

In some embodiments, any of the structures shown in FIGS. 3 through 10 may be used to provide two gas pressure operated rams substantially as shown in any of the foregoing figures arranged on one housing as shown in the figures or two separate housings coupled longitudinally. In some embodiments, the two rams may be disposed on a same side of the one or two housings. In some embodiment, the two rams may be disposed on opposed sides of the through bore 14 in either a single housing or in two housings such that two rams operated in opposed directions.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A kinetic ram for a blowout preventer, comprising:

a first pressure chamber having a first piston movably disposed therein;

the first piston having at least one pressure relief hole formed thereon, wherein the at least one pressure relief hole provides a passage into the body of the first piston;

a first gas generating charge disposed at one end of the first pressure chamber;

a first ram coupled to the first piston on a side of the first piston opposed to the first gas generating charge; and the first ram arranged to move across a through bore in a first blowout preventer housing disposed at an opposed end of the first pressure chamber when the first gas generating charge is actuated to create a pressure increase within the first pressure chamber.

2. The kinetic ram of claim 1 wherein an initial volume in the first pressure chamber between the one end and the first piston is chosen to limit a maximum pressure caused by actuating the first gas generating charge to at most five times an operating pressure to accelerate the first piston to a selected velocity.

3. The kinetic ram of claim 1 wherein an initial volume in the first pressure chamber between the one end and the first piston is chosen to limit a maximum pressure caused by actuating the first gas generating charge to at most three times an operating pressure to accelerate the first piston to a selected velocity.

4. The kinetic ram of claim 1 wherein an initial volume in the first pressure chamber between the one end and the first piston is chosen to limit a maximum pressure caused by actuating the first gas generating charge to at most one- and one-half times an operating pressure to accelerate the first piston to a selected velocity.

5. The kinetic ram of claim 1 wherein an initial volume in the first pressure chamber is chosen by locating the first piston at a selected initial distance between the first gas generating charge and the first piston.

6. The kinetic ram of claim 1 further comprising a restraint arranged to hold the first piston at an initial position until pressure in the first pressure chamber exceeds a selected pressure.

7. The kinetic ram of claim 6 wherein the restraint comprises at least one shear pin.

8. The kinetic ram of claim 1 wherein the at least one pressure relief hole is covered by at least one burst disk.

9. The kinetic ram of claim 1 wherein the at least one pressure relief hole provides a passage from one side of the first piston to the other side of the first piston.

10. The kinetic ram of claim 1 further comprising a restraint coupled to the first piston and arranged to hold the first piston against pressure in the first pressure chamber until the pressure in the first pressure chamber exceeds a selected pressure.

11. The kinetic ram of claim 10 wherein the restraint comprises at least one shear pin.

12. The kinetic ram of claim 10 wherein the restraint comprises an integral attachment forming part of the first gas generating charge or first gas generating charge housing.

13. The kinetic ram of claim 1, further comprising:

a second pressure chamber having a second piston movably disposed therein;

the second piston having at least one pressure relief hole formed thereon, wherein the at least one pressure relief hole provides a passage into the body of the second piston;

a second gas generating charge disposed at one end of the second pressure chamber;

a second ram coupled to the second piston on a side of the second piston opposed to the second gas generating charge; and the second ram arranged to move across the through bore or a through bore in a second blowout preventer housing disposed at an opposed end of the second pressure chamber when the second gas generating charge is actuated to create a pressure increase within the second pressure chamber.

14. The kinetic ram of claim 13 wherein an initial volume in the second pressure chamber between the one end and the second piston is chosen to limit a maximum pressure caused by actuating the second gas generating charge to at most three times an operating pressure to accelerate the second piston to a selected velocity.

15. The kinetic ram of claim 13 wherein an initial volume in the second pressure chamber between the one end and the second piston is chosen to limit a maximum pressure caused by actuating the second gas generating charge to at most one- and one-half times an operating pressure to accelerate the second piston to a selected velocity.

16. The kinetic ram of claim 13 wherein an initial volume of the second pressure chamber is chosen by locating the second piston at a selected initial distance between the second gas generating charge and the second piston.

17. The kinetic ram of claim 13 wherein the at least one pressure relief hole is covered by at least one burst disk.

18. The kinetic ram of claim 13 wherein the at least one pressure relief hole provides a passage from one side of the second piston to the other side of the second piston.

19. The kinetic ram of claim 13 further comprising a restraint coupled to the second piston and arranged to hold the second piston against pressure in the second pressure chamber until the pressure in the second pressure chamber exceeds a selected pressure.

20. The kinetic ram of claim 19 wherein the restraint comprises at least one shear pin.

21. The kinetic ram of claim 19 wherein the restraint comprises an integral attachment forming part of the second gas generating charge or a gas-generating charge housing.

22. The kinetic ram of claim 19 wherein the restraint comprises a shear bolt attaching a gas generator charge to the second piston.

23. The kinetic ram of claim 13 wherein the first ram and the second ram move in opposed directions with respect to the through bore.

* * * * *